United States Patent [19]

Phillips

[11] 4,173,384

[45] Nov. 6, 1979

[54] FLEXIBLE CO-AXIAL CONNECTOR FOR CABLE IN-LINE ELECTRONICS

[75] Inventor: Raymond J. Phillips, Oakdale, Conn.

[73] Assignee: The United States of America as represented by the Secretary of the Navy, Washington, D.C.

[21] Appl. No.: 936,541

[22] Filed: Aug. 23, 1978

[51] Int. Cl.[2] ..... H01R 13/56

[52] U.S. Cl. ..... 339/101; 339/142

[58] Field of Search ..... 339/101, 108 R, 110 R, 339/136 R, 137, 139 R, 142

[56] References Cited

U.S. PATENT DOCUMENTS

| | | | |
|---|---|---|---|
| 3,196,382 | 7/1965 | Morello, Jr. | 339/101 X |
| 3,264,449 | 8/1966 | Brenner | 339/101 X |
| 3,721,939 | 3/1973 | Paugh | 339/101 X |

*Primary Examiner*—Roy Lake
*Assistant Examiner*—DeWalden W. Jones
*Attorney, Agent, or Firm*—Richard S. Sciascia; Arthur A. McGill; Prithvi C. Lall

[57] ABSTRACT

A co-axial radio frequency flexible connector system for use in traversing through and/or over sheaves, hull fittings, cable handling equipment and machinery, and reeling operations. The system comprises a bellows enclosing a spring assembly. The bellows provides a fixed length electrical path which remains the same during flexing, tension and compression. The system is radially rigid to inhibit rotation of components. Electrical contact engagement is enhanced by having the components under a pre-determined amount of compression when assembled and in use.

5 Claims, 7 Drawing Figures

FLEXIBLE CO-AXIAL CONNECTOR FOR CABLE IN-LINE ELECTRONICS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to an electrical connector and more particularly to a connector for use in an in-line assembly that is compatible with a plurality of existing antenna systems now in use aboard submarines.

One of the requirements of in-line equipment, such as connectors, fittings, and housing in many systems is that the components do not exceed the diameter of the cable or wire that is to be used in conjunction with the components. This enables each component to be compatible with the existing stuffing tubes, seals and mechanisms that are normally found. In addition, an optimum connector should be flexible, have good tensile strength and inhibit rotation to prevent the breaking of electrical connections.

In comparison to the present invention, prior art connectors are generally heavy, are less flexible, have less tensile strength and do not inhibit rotational force in the area of the electrical connections.

SUMMARY OF THE INVENTION

It is, therefore, a general object of the present invention to provide an improved connector assembly for electrical and/or electronic equipment. Another object is that the connector has a diameter smaller than the cable it services and be suitable for insertion into a housing such as that described in U.S. patent application Ser. No. 828,710. Further objects are that the connector assembly be flexible but inhibit rotation. Additional objects are that the device be lighter and relatively inexpensive when compared to prior art systems. These and other objects of the invention and the various features and details of construction and operation will become apparent from the specification and drawing.

This is accomplished in accordance with the present invention by providing a connector assembly with mating components to limit rotation while providing flexibility. These include components with mating walls to prevent rotation. These components are in series with a spring inserted in apertures and the assembly provides for flexibility but not rotation. An inner electrically conductive wire passes through apertures in the assembly. The outer conductor has for one of its components a flexible bellows that resists rotation. The bellows provides a fixed length electrical path in addition to the above mechanical considerations.

DESCRIPTION OF THE PREFERRED EMBODIMENT

Figures 1, 2, 3, 4, 5, 6, 7:
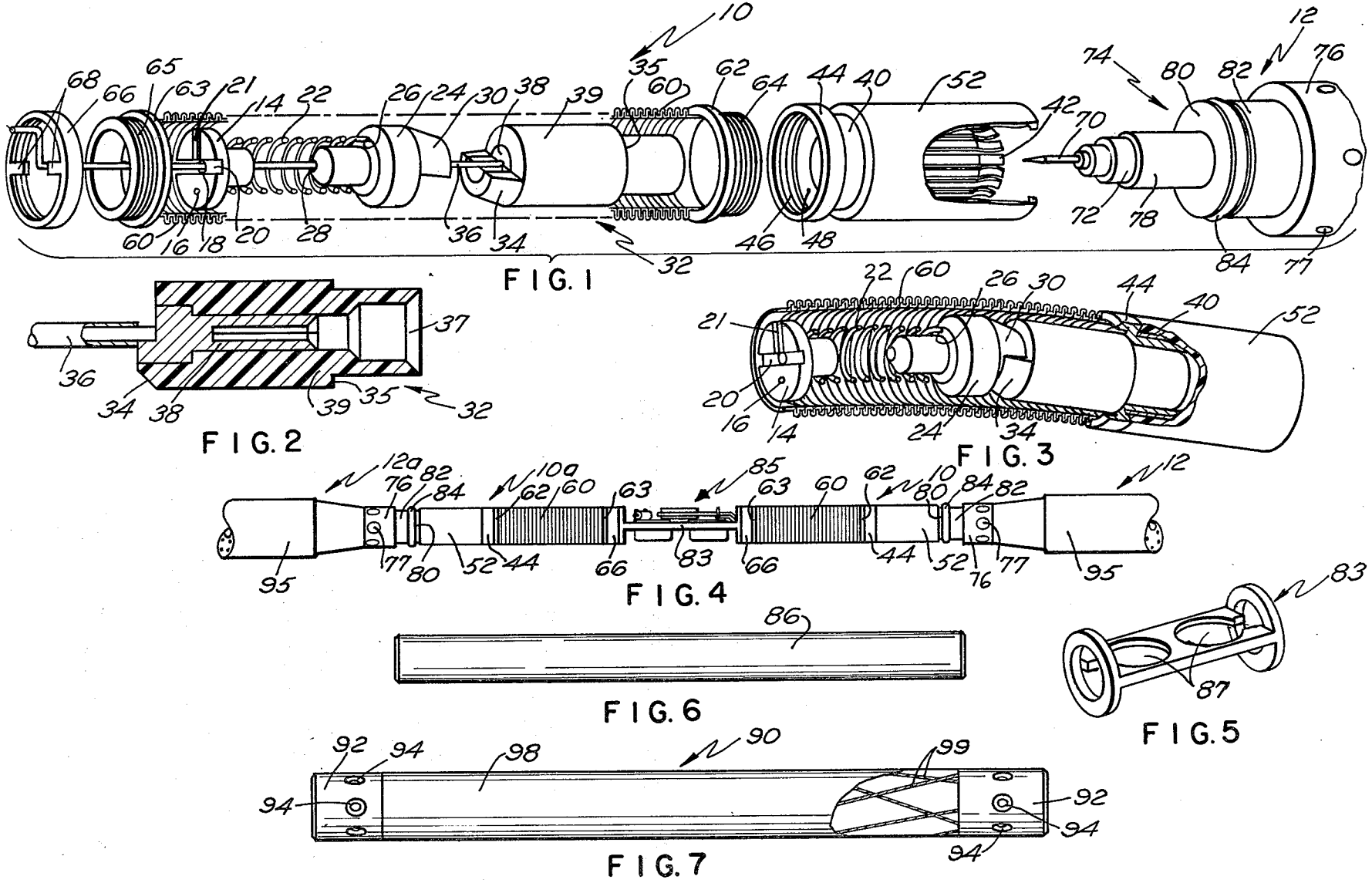
FIG. 1 is an exploded view of an electrical connector assembly and an associated cable assembly in accordance with the present invention.
FIG. 2 is a sectional view of the insulated socket connector of FIG. 1.
FIG. 3 is a perspective view showing the flexibility of the electrical connector assembly of FIG. 1.
FIG. 4 is a view showing the connector assembly and associated cable assembly of FIG. 1 in a typical in-line assembly.
FIG. 5 is a perspective view of the chassis of FIG. 4.
FIG. 6 is a view of a flexible tube suitable for enclosing the connector assembly and chassis of FIG. 4.
FIG. 7 is a flexible housing suitable for enclosing portions of the assembly of FIG. 4 and tube of FIG. 6.

Referring now to FIG. 1 there is shown an exploded view of a co-axial radio frequency contact connector assembly 10 and its mating cable assembly 12.

The connector assembly 10 has a plurality of components to be described. The first of these is a spring seat 14 made of insulating material. The spring seat 14 has apertures 16 and 18, and grooves 20 and 21. A flexible spring 22 is affixed to spring seat 14 by inserting an end of the spring 22 through aperture 16. The other end of the spring 22 is affixed to a spring cap 24 by passing the end through an aperture 26. The spring cap 24 is made of insulating material. It has in addition to the above a center aperture 28 and a split end 30.

An insulated socket connector 32 has a split end 34 abutting split end 30 of spring cap 24. The abutting of ends 30 and 34 prevents relative rotation between cap 24 and connector 32. The socket connector 32 has an electrical wire 36 connected to the back end of feedthrough socket 38. The wire 36 extends through center aperture 28 of spring cap 24, the center of spring 22 and aperture 18 of spring seat 14.

A sectional view of connector 32 is shown in FIG. 2. The wire 36 is soldered to the feedthrough socket 38. The socket 38 is encapsulated in an insulating material 39 along its length. The insulation 39 has a wall 35 orthogonal to the connector 32 axis and an aperture 37 at the end opposite wire 36.

Referring again to FIG. 1, a metallic contact ring 40 forms part of an outer conductor. The contact ring 40 has flexible spring fingers 42 with a ferrule 44 at the opposite end. The ferrule 44 has interior threads 46 and a collar 48. The collar 48 in assembly abuts wall 35 of connector 32. An insulator sleeve 52 fits over spring fingers 42 and abuts ferrule 44.

A flexible bellows 60 forms a part of the outer conductor. It has at one end a ring 62 with screw threads 64 and at the other end a ring 63 with screw threads 65. The screw threads 64 mate with threads 46 of contact ring 40. At the other end of the bellows 60, the threads 65 mate with a threaded ring 66. The ring 66 has tabs 68 that fit in grooves 20 of spring seat 14 for holding spring seat 14 in place within bellows 60.

Cable assembly 12 has a pin 70 for insertion into socket 38. The pin 70 is connected to wire 72. The wire 72 is inserted in flanged piece 74 that is connected to end piece 76. End piece 76 has threaded apertures 77. Flanged piece 74 has a cylindrical projection 78, flange 80 and head 82. An O-ring 84 is inserted in the neck portion of piece 74 between flange 80 and head 82. A cable jacket 95 (see FIG. 4) is molded on end piece 76.

On assembly, pin 70 is inserted through aperture 37 into socket 38 and flexible spring fingers 42 grasp projection 78 of flanged piece 74. The insulator sleeve 52 positions connector assembly 10 with respect to cable assembly 12 by having opposite ends of sleeve 52 abutting ferrule 44 and flange 80.

Referring now to FIG. 3 there is shown the flexibility of contact connector assembly 10 due to the action of spring 22 and bellows 60. Rotation of components is limited due to the ends of spring 22 being inserted in apertures 16 and 26, and mating notches of split ends 30 and 34. The bellows 60 provides a fixed length electrical path which remains the same during flexing, tension and compression. In addition, the bellows 60 and spring 22 allow for a design whereby these parts are under a pre-determined amount of compression when assembled and in use. This aids in the continuation of correct contact engagement while the cable is under tension and some elongation of the associated parts occurs.

In use, the pin 70 and socket 38 become fully seated and the flexible spring 22 party compressed as the outer contact spring fingers 42 become fully engaged. This allows for more tolerance in cable/connector assembly, and also insures continued engagement of the contacts notwithstanding adverse tension flexing of the cable 95 during handling or in use.

FIG. 4 shows a typical use of contact connector assemblies in an antenna system. Cable assemblies 12 and 12*a* are connected to respective connector assemblies 10 and 10*a*. An amplifier chassis 83 is brazed to assemblies 10 and 10*a*. The chassis 83 has various electrical and electric components 85. Assemblies 10*a* and 12*a* differ from assemblies 10 and 12 only in that the pin and socket components are interchanged. The chassis 83 can be affixed by silver brazing to either ring 66 or directly to bellows 60 if it is preferable to eliminate rings 63 and 66. The chassis 83 and components 85 normally obstruct aperture 18 in FIG. 1 making it necessary to pass wire 36 through groove 21 before extending it toward the chassis 83.

FIG. 5 shows a view of chassis 83, made of beryllium copper with apertures 87 to aid in affixing the various electrical and electronic components 85 of FIG. 4. After components 85 are affixed, the chassis 83 can be embedded in epoxy (not shown) if desired.

FIG. 6 shows a flexible tube 86 for enclosing components 10, 83, 85 and 10*a* of FIG. 4. The tube 86 fits snugly over the components and provides a sealing surface if the assembly is to be subjected to external water pressure.

FIG. 7 is a strong flexible housing 90 that covers tube 86 and connects to cable assemblies 12 and 12*a*. The housing 90 has stainless steel end terminations 92 with apertures 94 for insertion of screws. The end terminations 92 mate with components 76. The housing 90 has a coating 98 of flexible material and strength members 99 made of steel wires, woven or braided in a basket weave configuration embedded in coating 98.

The components of FIGS. 6 and 7, chassis 83 and cable assemblies 12 and 12*a* are not part of the present invention but are shown only to aid one in an understanding of a use of the invention. Many of these components are shown in more detail in the U.S. patent application Ser. No. 828,710.

There has, therefore, been described a system that when under compression, tension, flexing and/or eternal pressure shows a minimum or no effect on signals in the ELF to VHF range. The system is sufficiently rugged to careless connecting techniques. The non-twist feature prevents accidental contact twistoff and lead twist breakage. The system can be modified to a longer or shorter assembly, smaller or greater diameter, increasing bellows wall thickness, and/or material for greater or lesser spring rate and compression ability. The actual contact areas can be changed to accept differing voltage or current requirements. The design can be modified to be used with multi-conductor wire and contacts, thereby having wider usage in in-line electronic adaptions.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A flexible electrical connector system for inhibiting rotation comprising:

an insulated electrical connector having a split end and an electrical feedthrough with said split end adapted for connecting an electrical wire and the end opposite said split end suitable for receiving an external electrical conductor.

a spring cap having a split end suitable for abutting said insulated electrical connector split end so as to prevent relative rotation between said spring cap and said insulated electrical connector, said spring cap further having a first aperture adapted for passing through said electrical wire and a second aperture;

a flexible spring having one end inserted in said second aperture of said spring cap and adapted to have said electrical wire fed axially through said spring; and a spring seat having a first aperture adapted to pass through said electrical wire and a second aperture having the other end of said flexible spring inserted therein.

2. A flexible electrical connector system according to claim 1 further including a bellows enclosing along the axial length the combination of said insulated electrical connector, said spring cap, said flexible spring and said spring seat, said bellows forming an outer electrical conductor.

3. A flexible electrical connector system according to claim 2 further comprising a contact ring affixed to an end of said bellows and abutting said insulated electrical connector, said contact ring being metallic and forming an outer electrical conductor.

4. A flexible electrical connector system according to claim 3 wherein said contact ring further comprises:

a ferrule; and a metallic sleeve having spring fingers connecting said ferrule.

5. A flexible electrical connector system according to claim 4 further comprising an insulator sleeve enclosing said metallic sleeve of said contact ring along the length of said metallic sleeve.

* * * * *